United States Patent [19]

Lanning

[11] 4,176,840

[45] Dec. 4, 1979

[54] WRIST SUPPORT

[76] Inventor: Michael E. Lanning, 15734 Hummel Rd., Brook Park, Ohio 44132

[21] Appl. No.: 883,540

[22] Filed: Mar. 6, 1978

Related U.S. Application Data

[63] Continuation-in-part of Ser. No. 469,213, May 13, 1974, abandoned.

[51] Int. Cl.[2] ..... A63B 69/00

[52] U.S. Cl. ..... 273/54 B; 273/189 A

[58] Field of Search ..... 273/54 B, 189 A; 128/77, 87 R, 89 R, 90; 2/161 A, 321, 322; 24/68 T, 71 T, 71 J, 75, 78

[56] References Cited

U.S. PATENT DOCUMENTS

| | | | |
|---|---|---|---|
| 2,429,926 | 10/1947 | Davis | 24/78 X |
| 3,423,095 | 1/1969 | Cox | 273/189 A |
| 3,606,342 | 9/1971 | Albertson | 273/54 B X |

*Primary Examiner*—Anton O. Oechsle

*Attorney, Agent, or Firm*—Fleischner, Schutz and Henn

[57] ABSTRACT

A brace, limiting movement of the wrist of a user, is disclosed. A bar with padded supports bears on the back of the hand and the forearm of the user when the bar is secured to the arm of the user. The point at which the bar is secured to the arm is designed to operate as the fulcrum of a simple lever, thus amplifying the efficiency of the brace. An adjustable strap, with a releasable latch means, secures the bar to the arm of the user.

1 Claim, 7 Drawing Figures

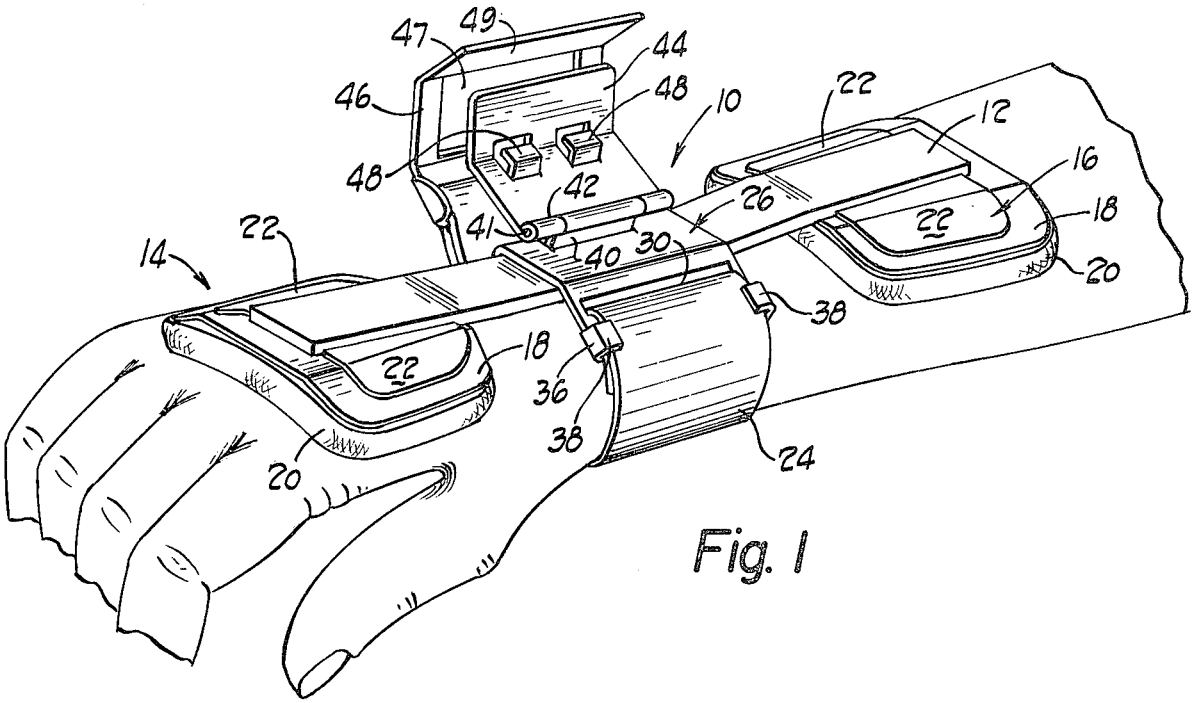
Fig. 1
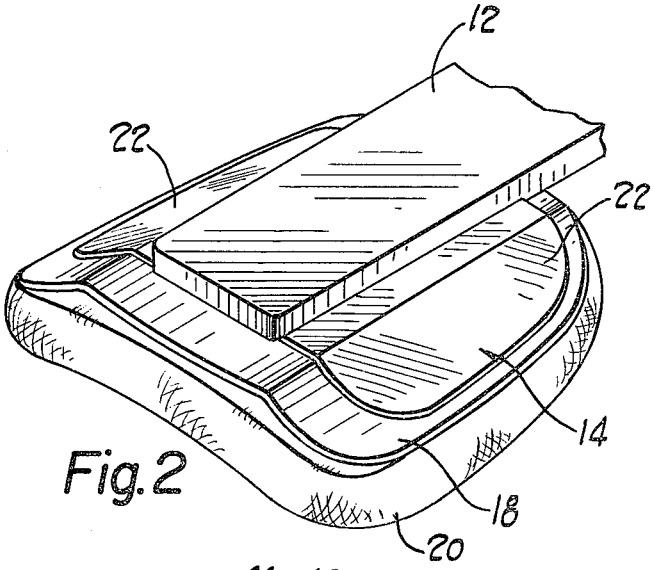
Fig. 2
Fig. 4
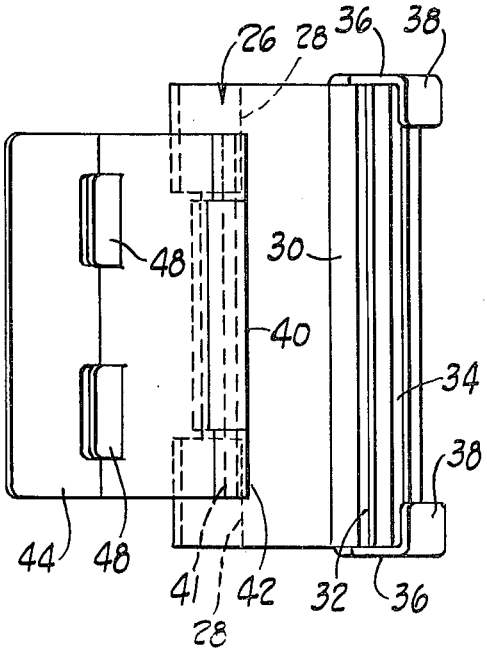
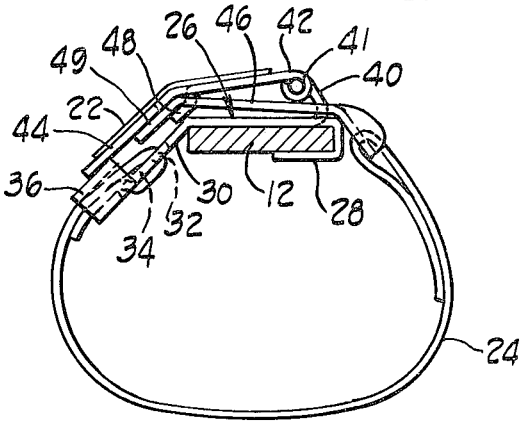
Fig. 3

WRIST SUPPORT

CROSS-REFERENCE TO RELATED APPLICATION

This application is a continuation-in-part of applicant's co-pending application Ser. No. 469,213, filed May 13, 1974, abandoned.

BACKGROUND OF THE INVENTION

1. Field of the Invention

This invention relates generally to a supporting brace with releasable latch means, attachable to the arm of a user, limiting the movement of the wrist of the user and, more particularly, to a support for the wrist of a bowler or other sportsman.

2. Description of the Prior Art

Sportsmen often have a need for some device to assure that the wrist remains substantially immobile relative to the remainder of the arm as the particular movement required by the sport is completed. In particular, bowlers are required to eliminate any twisting and/or flexing of the wrist while swinging the arm through an arc in order that the bowling ball is delivered at the appropriate position with respect to the pins. Often this quality of control may be voluntarily introduced by the bowler simply applying self-control. However, very often the control required is lacking to some degree due to either physical exhaustion or noncoordination. In situations such as these a crutch, such as some sort of brace, is the only realistic solution.

As is true in most sports and particularly bowling, in the event that a brace is to be utilized on the arm and hand of the bowler, particular attention must be directed to any portions which might place limiting restrictions on the movement of the fingers. Since the fingers are extremely important with respect to the holding and handling of a bowling ball, no degree of restraint of at least the thumb and two fingers, first and last, which support the bowling ball may be tolerated.

The following prior art U.S. Patents disclose or claim wrist support or control devices: U.S. Pat. Nos. 3,423,095; 3,606,342; 3,829,090; and 3,788,307. These U.S. Patents are not an inclusive list but are considered important examples with regard to the state of the prior art of the field of the present invention.

Several of the prior-art wrist-support devices result in some degree of restraint to the fingers. In some instances, the restraint comprises a glove type of structure which encircles all or only a few of the fingers. More frequently, a strap is included which circumscribes the palm of the hand, but without including the thumb. Although this last solution does not directly restrain the thumb, interference may result from the mere presence of the strap adjacent to the thumb. The remaining devices, designed to alleviate the problems of the twisting and flexing of the wrist, circumvent interference with the fingers only by losing control of the wrist movement to some extent.

But an even more important problem is left completely unsolved by all of the devices presently available for supporting the wrist of a sportsman. In this regard, once the braces of the prior art have been installed on the arm of the user and the appropriate adjustment has been made, removal of the brace from the arm, for any reason, loses the adjustment.

Such loss of adjustment becomes an important consideration where a considerable amount of time is required to obtain the proper adjustment of the brace. Such is the case when a bowler utilizes a brace to assist in the support of the wrist. The continual readjustment of the brace is an unsatisfactory condition required of the present devices for supporting the wrist of bowlers in particular.

SUMMARY OF THE INVENTION

A general object of this invention is the provision of a new and improved support for the wrist of a sportsman.

Other objects of this invention include the provision of a new and improved wrist support which maintains the back of the hand in a straight-line relationship with the forearm of a user; which restrains the wrist from undesirable flexing and twisting; which causes a counteracting force to be produced when any undesired wrist movement is attempted; and, which causes such a force which increases as the degree of movement increases.

Another object of this invention includes the provision of a new and improved wrist support which is adjustable in order to adapt to the particularities of the arm of the user.

Further objects of this invention include the provision of a new and improved wrist support which is removably attached to the arm of the user and which does not result in the loss of adjustment when the support is removed from the arm of the user.

Still other objects of this invention include the provision of a new and improved wrist support which does not restrain forward bending of the wrist of the user; which does not in any manner encumber the fingers of the user; and which further does not restrict the palm of the hand in any way.

Yet another object of this invention includes the provision of a new and improved wrist support which utilizes a simplified latching arrangement for attaching the support to the arm of the user without adversely effecting the adjustment of the support.

Other objects of this invention include a new and improved wrist support which is attached to the arm of the user at the wrist; which extends from the wrist to both the back of the hand and the forearm of the user; which causes a corresponding force to be exerted onto the forearm whenever the hand is attempted to be moved against the support; and which causes such a force which increases as the degree or force of movement or attempted movement increases.

A still further object of this invention is to provide a new and improved wrist support which obtains one or more of the objects and advantages set forth above.

These and other objects and advantages of this invention will become apparent from the following description thereof, in view of the accompanying drawings.

BRIEF DESCRIPTION OF THE DRAWINGS

FIG. 1 is a perspective view of the support of the invention positioned for use on the arm of a user.

FIG. 2 is an enlarged view of one of the pads of the support in perspective.

FIG. 3 is a cross-sectional view of the support illustrating the strap and fastening means in a latched position.

FIG. 4 is a plan view of the clip which attaches the strap to the bar of the support.

DESCRIPTION OF THE PREFERRED EMBODIMENT

Figure 5:
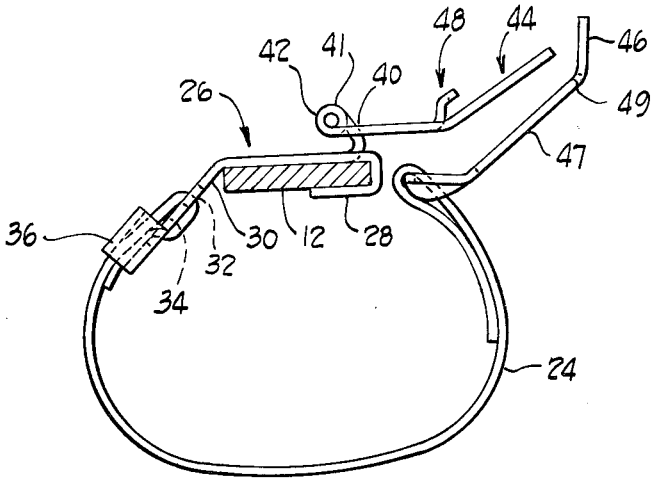
FIG. 5 is a cross-sectional view of the support, illustrating the strap and fastening means in an unlatched position.

The wrist support, indicated generally at 10, of the present invention is illustrated in place on the arm of a user in FIG. 1. A substantially inflexible bar 12 is positioned in parallel alignment with the arm of the user. A support structure 14 is attached to the end of the bar 12 in a manner to bear upon the back of the hand of the user. Likewise, another support structure 16 is attached to the other end of the bar 12 in a manner to bear upon the forearm of the user.

Both of the support structures 14 and 16 are designed similarly, and therefore a detailed discussion of one will suffice for both. In this respect, FIG. 2 illustrates the support structure 14 in greater detail.

A plate 18 serves as the basic element of the support structure 14 and is attached to the bar 12 by any suitable means such as, for example, welding, bolting or riveting. The plate 18 is preferrably beveled at both sides to form a channel-like structure substantially conforming to the back of a normal hand. The plate 18 has bonded thereto, by any suitable means, as for example, epoxy glue, a shock-absorbing cushion 20. The cushion 20 may be constructed of any material portraying characteristics sufficiently similar to foam-rubber or other shock-absorbing materials.

The purpose of the plate 18 and cushion 20 is to provide a comfortable but firm support for the back of the hand of the user. The support structure may include cover portions 22 which serve no function other than aesthetic purposes.

The other support structure 16, as noted above, is substantially identical to the support 14. In this regard, the plate 18, shock-absorbing cushion 20 and cover portions 22 are present. The only significant difference which should be noted with regard to the support structure 16 is that the beveled sides of the plate 18 can be more exaggerated than in the case of the support structure 14. The reason for this difference can be found in the structure of a normal arm. As a general rule, the forearm of an arm is of lesser width than the back of the hand. In this respect, in order that the support structure 16 embrace the forearm of the user to provide proper support therefor, the plate 18 of the support 16 can be constructed to form a channel of less width than that of the support 14.

Once the bar 12 with the support structures 14 and 16 at each end thereof has been positioned on the arm of the user, as shown in FIG. 1, this position is desired to be maintained by securing the bar 12 to the arm. For this purpose, a fastening means to be described below is provided. Preferably, strap 24 is provided to secure the bar 12 to the arm. The stap 24 is preferably constructed of leather, or leatherlike material, but is not necessarily limited thereto. The dimensions of the strap 24 are not critical to the invention; however, the length of the strap must be sufficient to encircle the wrist of any normal arm.

The strap 24 is attached to the bar 12 by reason of a clip, indicated generally at 26. FIG. 3 shows a side view of the clip 26 while FIG. 4 illustrates the clip is basically constructed from a sheet material, formed to obtain the necessary functions. In this respect, one end, indicated at 28, of the clip tightly constricts a portion of the bar 12. In this manner the clip 26 is firmly attached to the bar 12.

The opposite end, indicated generally at 30, of the clip is constructed to allow the strap 24 to be attached to the clip 26. For this reason, the clip 26 is constructed to be at least as wide as the strap 24. Further, a first way 32 is provided in the end 30 of the clip 26 of a sufficient size to allow the strap 24 to pass therethrough. A second way 34 is also provided in the end 30 of the clip, again of a sufficient size to allow the strap 24 to pass therethrough. In addition, a restrictive passage 36 is provided at the extreme end of the clip 26. The first 32 and second 34 ways and the restrictive passage 36 combine to restrain the strap 24 from movement once positioned.

With the clip 26 constructed as described above, the strap 24 is secured to the clip by inserting the strap into the restrictive passage 36, looping the strap through the first way 32, then through the second way 34, and finally back through to restrictive passage 36. In this manner, the strap 24 encircles a portion of the end 30 of the clip and is thereby restrained from movement once positioned tightly against the end 30 of the clip 26.

Although the restrictive passage 36 of the clip 26 is shown in the figures as having only two small members 38 restraining the strap 24, the functions of the invention are not affected by the particular design of this portion of the clip. In this manner, the restrictive passage 36 may include a continuous bar on top of the strap 24 as is present beneath the strap. The function of the restrictive passage 36, whatever the particular design thereof might be, in conjunction with the first 32 and second 34 ways is to restrain the strap 24 from movement once positioned, as noted above.

Further, the passage 36 and ways 32 and 24 constitute a means of adjusting the overall effective length of the strap 24. Thus, by overlapping increasing amounts of the strap 24 within the end 30 of the clip 26 the strap decreases in effective or useful length.

The clip 26 also includes a hinge member 40 constructed as an integral part of the clip. The hinge member 40 is connected by a hinge pin 41 to another hinge member 42 which is formed from a portion of a latch means. In the preferred embodiment, latch 44 serves a purpose more fully described hereinbelow.

At the end of the strap 24 which is most removed from the end 30 of the clip, a clamp means such as clamp 46 is attached by any suitable means such as overlapping the strap with a portion of the clamp 46 therebetween and securing the strap material. The strap material may be secured by any means, and is preferably bonded as by gluing.

The clamp 46 is designed to include an aperture of a sufficient size to receive therein the latch 44. Further, the latch 44 includes protruding catches 48 which are designed to abut an edge 49 of the clamp 46 when the latch is inserted into the aperture 47.

With the portions of the wrist support 10 as described above, adaptation of the support to the arm of a user is a fairly simple procedure. In this respect, the wrist support 10 is placed on the arm of the user in a manner resulting in the support structure 14 resting on the back of the hand and the support structure 16 resting on the forearm. The strap 24 is extended around the wrist. The edge 49 of the clamp 46 is placed in the depression formed by the intersection of the catches 48 and the latch 44. The latch 44 is then pivoted on the hinge member 40, causing the clamp 46 to rest on the clip 26 as shown in FIG. 3. The strap 24 at this point secures the wrist support 10 to the arm.

Figure 6:
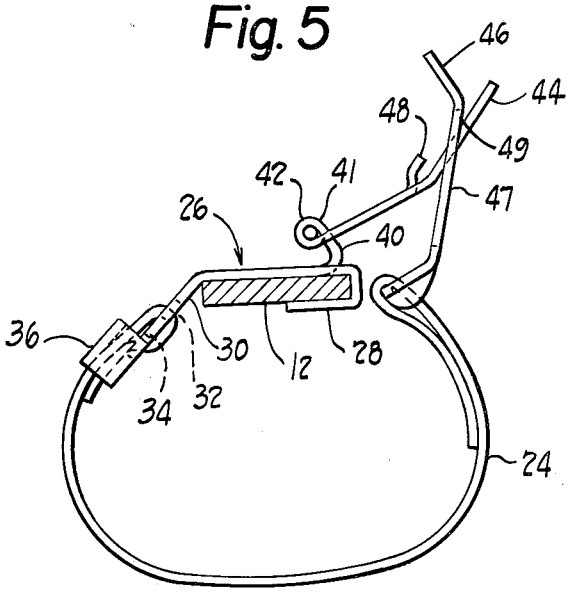
FIG. 6 is a cross-sectional view of the support, illustrating the strap and fastening means beginning to enter the latched position.
Figure 7:
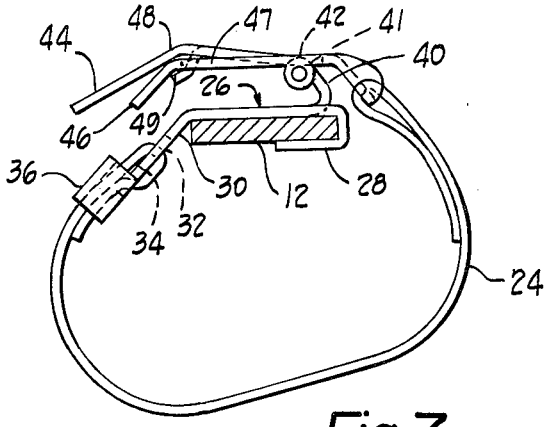
FIG. 7 is a cross-sectional view of the support, illustrating the strap and fastening means in an almost fully latched position.

FIGS. 5,6 and 7 in addition to FIGS. 1 and 3 further illustrate the operation of the latch means and clamp means, cooperating to allow a rapid latching arrangement for attaching the support to the arm of the user without adversely affecting the adjustment of the support. The wrist support 10 is shown in a fully open or unlatched position in FIGS. 1 and 5. The clamp 46 and the latch 44 are completely separated. FIG. 6 shows the beginning of the closing or latching operation. Clamp 46 is brought toward latch 44 and over the end of the leading edge of latch 44 so that latch 44 begins to come through aperture 47 of clamp 46. FIG. 7 shows the latching operation as it progresses. After the beginning of the operation as described and shown in FIG. 6, both the latch 44 and clamp 46 are brought toward clip end 30. The edge 49 of the clamp 46 is placed in the depression formed by the intersection of catches 48 and latch 44. Finally the latch 44 is pivoted on hinge member 40, causing the clamp 46 to rest on clip 26 in a fully closed position as shown in FIG. 3. It will be noted that the over-center conformation of catches 48 causes the latching means to remain in a latched position due to the stress thereon exerted by strap 24. The latching means must be opened by affirmative action of the user.

Of course, the extent to which the strap 24 bears upon the wrist depends upon the arrangement of the strap at the end 30 of the clip 26. As noted above, the effective length of the strap 24 is adjustable by means of the restrictive passage 36 and the first 32 and second 34 ways of the clip 26. In this regard, the preferred length of the strap 24 is such that the support 10 is quite securely fastened to the arm without causing undue restriction of internal bodily functions.

Preferably, the bar 12 is designed to be of a length approximately three times the width of the strap 24. With the clip 26 and thus the strap centered on the bar 12, equal lengths of the bar extend to the back of the hand and the forearm. Once the support 10 is securely attached to the arm, the bar 12 acts as a lever when the user attempts to bend the hand backwards, whether consciously or inadvertently. The strap 24, and more particularly the edge of the strap at the wrist, functions as the fulcrum of the lever. In this manner, the length of the bar from this fulcrum to the end at the forearm is equal to twice the length from this fulcrum to the end at the back of the hand. These distances are a direct consequence of the bar 12 having a combined length of the three equal portions are described above.

The resultant effect of the arrangement of the bar 12 results in a resisting force being exerted when the hand is attempted to be bent backwards. This restricting force increases as the pressure due to bending of the hand increases. Thus, the support 10 tends to restrain any backwards movement of the hand of the user.

Further, since the support structure 14 is designed to conform relatively closely to the shape of the back of the hand, any twisting movement of the wrist tends to be resisted by the pressure of the support structure 14 firmly held in place. Again, the pressure of the support structure increases as the twisting of the hand increases.

Modifications, changes and improvements to the preferred forms of the invention herein disclosed, described and illustrated may occur to those skilled in the art who come to understand the principles and precepts thereof. Accordingly, the scope of the patent to be issued hereon should not be limited to the particular embodiments of the invention set forth herein, but rather should be limited only by the advance by which the invention has promoted the art.

What is claimed is:

1. A brace for supporting the wrist of a sportsman comprising: a rigid bar; a pair of support members disposed at opposite ends of said rigid bar, a first of said support members substantially conforming to the shape of a back of a hand, a second of said support members substantially conforming to the shape of a portion of a forearm; fastening means disposed between said first and second support members securing said bar to the user's arm at the wrist, said fastening means including strap means capable of attaining a plurality of lengths in order to adjust to the size of the wrist, a first end of said strap means permanently attached to said rigid bar by a clip, and a second end of said strap means having a clamping means attached thereto; a latching means which cooperates with said clamping means to releasably attach the second end of the strap to said rigid bar; and said brace is mounted on the user's arm by means of said strap encircling the wrist thereof, wherein said clip includes a hinge, and said latch means is connected to the clip at the hinge so that it can rotate about the hinge.

* * * * *